United States Patent [19]

Douglass, Jr. et al.

[11] Patent Number: 4,709,652

[45] Date of Patent: Dec. 1, 1987

[54] PNEUMATIC AUDIO SWEEP GENERATOR

[75] Inventors: Harold E. Douglass, Jr., Hanover; Joseph W. Mahaffee, III, Bowie, both of Md.

[73] Assignee: The United States of America as represented by the director of the National Security Agency, Washington, D.C.

[21] Appl. No.: 691,963

[22] Filed: Jan. 16, 1985

[51] Int. Cl.[4] ..... G10K 7/06

[52] U.S. Cl. ..... 116/140; 116/147

[58] Field of Search ..... 116/140; 137/826, 487, 137/557; 181/142, 139; 84/364

[56] References Cited

U.S. PATENT DOCUMENTS

| | | | |
|---|---|---|---|
| 471,015 | 3/1892 | Nessle | 116/140 |
| 1,324,784 | 12/1919 | Barr | 116/140 |
| 1,860,516 | 5/1932 | Thomas | 137/487 |
| 3,226,671 | 12/1965 | Padberg | 84/364 |
| 3,265,152 | 9/1966 | Kass | 181/142 |
| 3,802,283 | 4/1974 | Bahrton | 137/826 |
| 4,421,473 | 12/1983 | Londerville | 137/487 |

FOREIGN PATENT DOCUMENTS

| | | | |
|---|---|---|---|
| 7687 | 8/1898 | Norway | 116/140 |

*Primary Examiner*—Charles Frankfort
*Assistant Examiner*—Denis E. Corr
*Attorney, Agent, or Firm*—Thomas O. Maser; John R. Utermohle

[57] ABSTRACT

A pneumatic sweep generator for use as an audio source in tests near vocal frequency ranges. A horn, whose volume may be controlled by air pressure and whose tone may be controlled by air velocity, is connected to an air supply in a dual-circuit arrangement. Mechanical control devices, such as manual and pressure release valves, are located within the circuit to provide for tone and volume control. A reciprocating air cylinder continuously varies the air velocity within the horn to sweep the frequencies in an adjustable manner. Electromagnetic interference is totally eliminated by a complete absence of electrical devices in either the device or in necessary controls.

11 Claims, 4 Drawing Figures

PNEUMATIC AUDIO SWEEP GENERATOR

BACKGROUND OF THE INVENTION

1. Field of the Invention

Our invention relates to the field of audio test equipment, and more particularly to pneumatic audio frequency generators.

2. Description of the Prior Art

Laboratory audio frequency generators are normally electronic devices. Their components include speakers, coils, switches, etc., all of which naturally produce undesirable electromagnetic interference. The quality of any test is lowered, and the accuracy of test results is reduced, by the extent to which the frequency generator interferes with the operation of the equipment which is being tested. As an ideal, a frequency generator would produce no electromagnetic interference whatever.

Many types of audio equipment are intended primarily to receive and transmit the human voice. When these devices are to be tested, the test frequencies normally range from 300 hz to 3000 hz. Electronic frequency generators operating in this frequency range produce the undesirable effects noted above. Obviously, all electromagnetic interference could be eliminated merely by having an individual speak directly into the device to be tested. This method unfortunately introduces other equally undesirable problems, however. For example, the test volume and frequency are not precisely controllable. In most cases, any given individual would be unable to produce all necessary frequencies, and certainly not with any degree of precision.

There is a need for an audio frequency generator which is entirely free of electromagnetic interference. Other desirable features would include convenient adjustability for volume, frequency, range, and frequency sweep characteristics.

SUMMARY OF THE INVENTION

An audio sweep generator capable of precisely controlled volume and frequency characteristics, while simultaneously eliminating the undesirable interference inherent in electronic devices, may be constructed as a mechanically controlled pneumatic device. A rotating aperature air horn of the well known "wolf whistle" type may be driven with a dual path control circuit, one path of which may be used to control volume, and the other to control frequency. The frequency control path would include a compressed air driven piston connected to the horn, the speed of each stroke of the piston being independently adjustable by mechanical valves.

Accordingly, it is an object of our invention to provide a pneumatic audio sweep generator which overcomes the above-cited disadvantages in the prior art.

It is another object of our invention to provide an air horn having independent pitch and volume controls.

It is also an object to provide an audio tone generator with a frequency range covering that of the human voice.

Still another object is to selectively generate tones without inducing any electromagnetic interference.

Another object is to generate tones with a device having only mechanical devices for tone generation and control.

Another object is to provide a device capable of tonal sweeps over varying frequency ranges.

It is a still further object to generate audio tones having a linear, sinusoidal, or logorithmic sweep pattern.

Finally, it is an object to provide a device in which the length and slope of the sweep may be selectively controlled.

A pneumatic audio sweep generator having these and other desirable features would include: air-actuated means for generating an audio tone, the volume of said tone being dependent upon air pressure and the frequency of said tone being dependent upon air velocity; a source of compressed air; a first conduit connecting said air source and said generating means; air-actuated means for varying the velocity of air passing through said generating means; and a second conduit connecting said velocity varying means and said air source.

BRIEF DESCRIPTION OF THE DRAWINGS

Our invention may be best understood if the description which follows is read with reference to the drawings, in which.

DESCRIPTION OF THE PREFERRED EMBODIMENT

Figure 1:
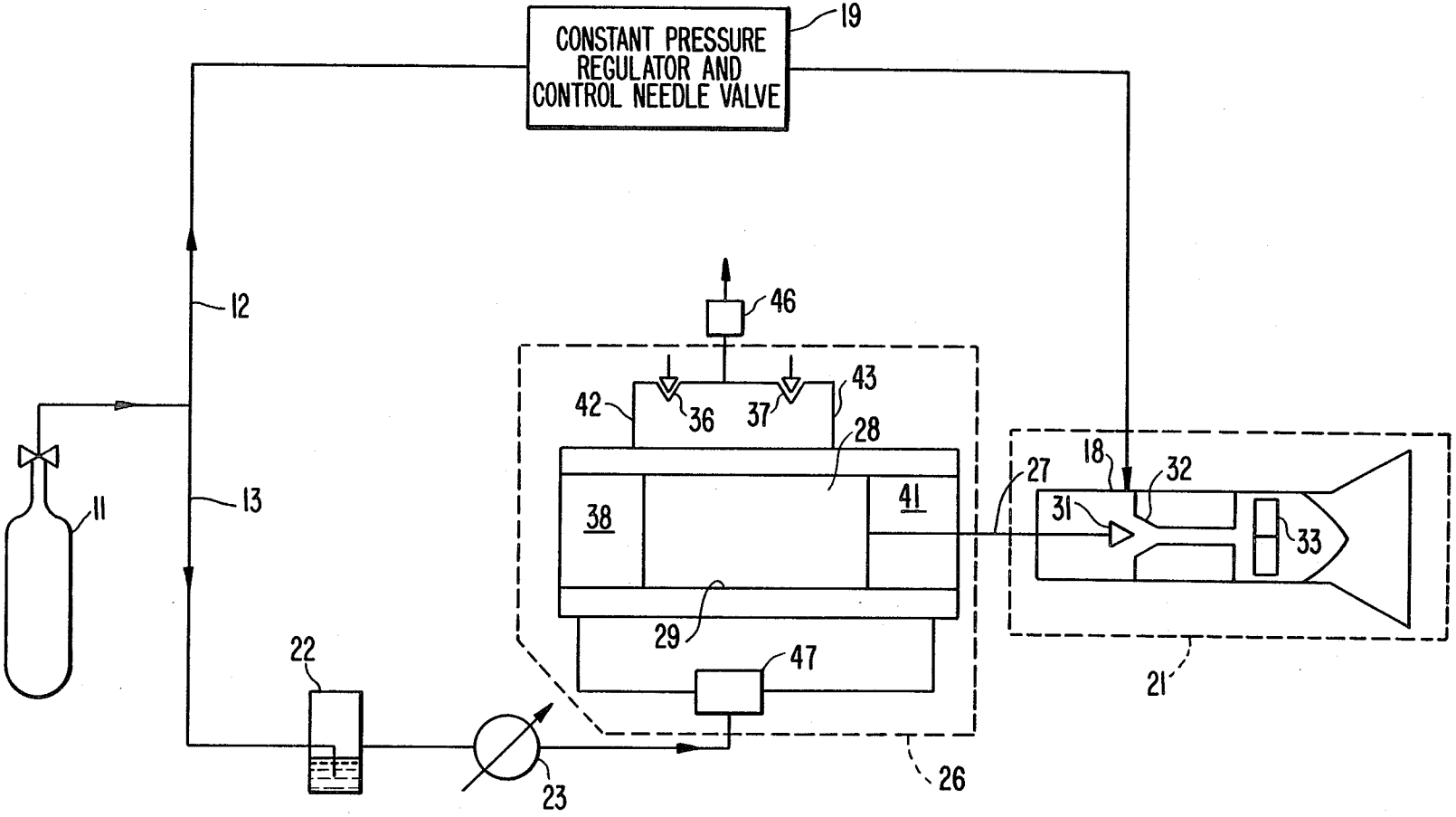
FIG. 1 is a schematic illustration of our invention.

FIG. 1 is a schematic illustration of our invention. An air pressure source 11 provides pressurized air to each of two conduits 12 and 13. Conduit 12 includes the combination 19 comprising a conventional needle valve and a pressure regulator connected in series as indicated by block 19. The needle valve allows manual adjustment of the flow rate of air through conduit 12, and provides the means for volume adjustments. The pressure regulator maintains a constant pressure at any given flow rate, and prevents unwanted volume fluctuations caused by changes in air pressure from source 11 by any conventional design using the regulator of block 19 and its constant pressure. Conduit 12 terminates at input 18 of a whistle 21. The volume of the sound produced by whistle 21 is controlled by the rate of flow of air from circuit 12. In particular, a high flow rate creates a louder tone and a low flow rate generates a softer tone.

The frequency of the sound emitted by whistle 21 is determined by the speed of rotation of an aperature 33. The speed of rotation is determined by the velocity of air passing through throat 32, and the air velocity is determined by the position of plunger 31 within the throat. More specifically, as the plunger is moved to the left out of the throat, the size of the space separating the throat and plunger increases. Because the quantity of air provided through conduit 12 is fixed (for a given tonal volume) the velocity of the air flow is necessarily reduced. The result is a slowing in the rotation of aperature 33 and a drop in the tonal frequency. Similarly, as shaft 27 moves to the right, the space between the throat and plunger diminishes. The air velocity to aperature 33 increases as does the tonal frequency. It is readily apparent that the movement of the plunger may be used also to control tonal sweep.

Conduit 13 includes a mist oiler 22 and a pressure regulator 23 connected in series, followed by a fluidics "OR" gate 26. The OR gate is a well-known, commercially available device, a representative type of which is manufactured and sold by the Allenair Corporation. A reciprocating piston 28 is positioned within a cylinder 29 to define a first chamber 38 and a second chamber 41. A shaft 27, rigidly affixed to piston 28, extends out of gate 26 and into whistle 21. Affixed to shaft 27 at the end opposite piston 28 is the detachable tapered plunger 31. A reciprocating motion by the piston and shaft will cause plunger 31 to move in and out of throat 32, thereby varying the tonal frequency as previously discussed. Mist oiler 22 provides continuous lubrication to the piston and cylinder, while pressure regulator 23 smoothes variations in air pressure provided by source 11 by holding constant the guage pressure at the output of regulator 23.

The fluidics OR gate 26 provides a means for controlling the reciprocating motion of plunger 31. In addition to the piston and cylinder previously discussed, it includes a sliding valve 47, the function of which is to alternately direct the compressed air flow from conduit 13 into either chamber 38 or chamber 41. Only one of the two chambers may receive air at any given time; hence, valve 47 must be constructed such that it seals the intake port to chamber 38 as it opens the intake port to chamber 41. Conversely, the intake part of chamber 41 must be sealed when the intake part to chamber 38 is opened. Each of the two chambers also has an output port. The output ports, also controlled by sliding valve 47, open and close in opposition to the corresponding input port. That is, the output port of chamber 38 must be closed when its input port is open, and its output port must be open when its input port is closed. Chamber 41 must have its output port open when its input port is closed, and its output port must be closed when its input port is open.

A first exhaust conduit 42 connects the output port of chamber 38 to the atmosphere through a needle valve 36. A similar exhaust conduit 43 allows air to flow from chamber 41 through a needle valve 37 to the atmosphere. A muffler 46 is advantageously placed as shown to restrict noise resulting from the escaping air.

Control of piston 28, and thereby control of the frequency of whistle 21, is effected by adjustment of needle valves 36 and 37. While the length of the stroke of piston 28 is fixed, the speed of both the forestroke and the backstroke may be independently controlled with the needle valves. Specifically, needle valve 37 will provide adjustment of the forestroke (toward whistle 21 in the figure), and needle valve 36 will control the backstroke. The valves achieve this function by regulating the speed at which air in the cylinders is permitted to escape, thereby affecting the velocity of the piston as it moves into he cylinder behind the escaping air.

Figure 2A:
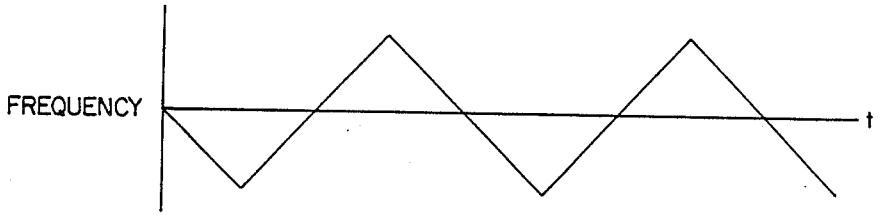
FIGS. 2A–2C illustrates representative frequency curves obtainable with the invention.
Figure 2B:
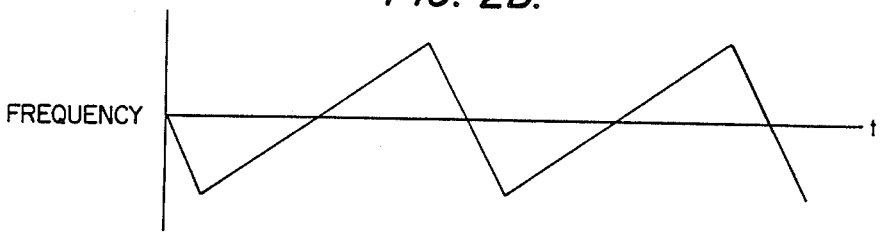
Figure 2C:
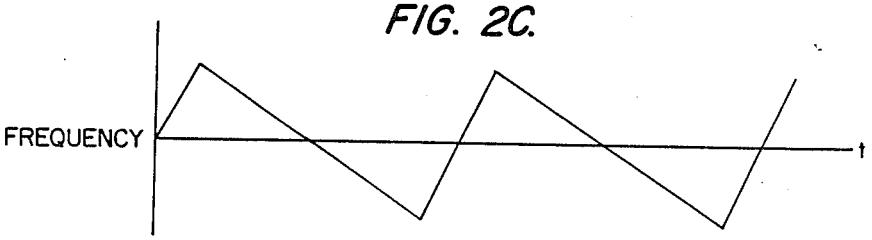

When valves 36 and 37 are balanced, piston 28 will move forward and backward at equal rates and a frequency curve as illustrated in FIG. 2A will be emitted by whistle 21. Opening valve 36 will cause the backstroke to occur more rapidily than the forestroke, and a frequency curve as illustrated in FIG. 2B will result. The frequency curve of FIG. 2C results if valve 37 is opened relative to valve 36. Opening both valves 36 and 37 causes the cycle to accelerate, while closing both valves will slow it. The range of frequencies emitted by whistle 21 is determined by the slope of plunger 31 and throat 32. By making these two pieces removable, a variety of frequency ranges may be selected by providing several plunger-throat combinations of varying tapers. A combination having a sharply angled taper produces a relatively narrow frequency range, while reducing the taper extends the frequency range. It is apparent from the foregoing that our invention is readily adjustable to varying volumes, frequencies, frequency ranges, cycles, and slopes. Significantly, all of these adjustments are possible without benefit of any electrical device which may introduce undesirable electromagnetic interference.

An operating embodiment of our invention was constructed in which compressed air at 25 to 75 pounds per square inch (psi) was supplied to each conduit. A conventional and commercially available wolf whistle was fitted with a plunger and throat. The Allenair "OR" gate was a Model AUVCR with a 1½ inch bore and a 1 inch stroke.

Our invention, which may be configured in many ways other than as described in the above preferred embodiment, is not intended to be limited to the specific structure illustrated. Its limitations are defined only in the claims which follow.

We claim:

1. An audio apparatus, comprising:

air-actuated means for generating an audio tone, the volume of said tone being dependent upon the rate of air flow and the frequency of said tone being dependent upon the velocity of air flow;

a source of compressed air;

a first conduit connecting said air source and said generating means;

means within said first conduit for regulating the rate of air flow therethrough;

air-actuated means for varying the velocity of air passing through said generating means;

said air-actuated means having periodically varying means to fluctuate said rate of air flow and thereby sweep frequencies periodically;

a second conduit connecting said velocity varying means and said air source; and means within said second conduit for regulating the pressure of air to said velocity-varying means.

2. The apparatus of claim 1 wherein said first conduit further comprises first mechanical means for varying the rate of air flow to said generating means.

3. The apparatus of claim 2 wherein said first mechanical means coprises a needle valve.

4. The apparatus of claim 1 wherein said tone generating means is a rotating aperture horn.

5. The apparatus of claim 4 wherein said horn further comprises a tapered throat for directing air flow from said first conduit to said aperture.

6. The apparatus of claim 5 wherein said horn further comprises a tapered plunger mounted for reciprocal movement within said throat.

7. The apparatus of claim 6 wherein said velocity varying means further comprises a reciprocatable piston rigidly coupled to said plunger.

8. The apparatus of claim 7 wherein said velocity varying means further comprises second mechanical means for varying the reciprocation speed of said piston.

9. The apparatus of claim 8 wherein said velocity varying means further comprises means for independently varying the speed of each stroke of said piston.

10. The apparatus of claim 9 wherein said speed varying means comprises a plurality of needle valves.

11. The apparatus of claim 6 wherein said throat and plunger are removable.

* * * * *